US009014584B2

(12) United States Patent
Murata et al.

(10) Patent No.: US 9,014,584 B2
(45) Date of Patent: Apr. 21, 2015

(54) IMAGE FORMING APPARATUS CONTROLLING VOLTAGE APPLIED TO TONER TRANSFER UNITS

(71) Applicant: Canon Kabushiki Kaisha, Tokyo (JP)

(72) Inventors: Naofumi Murata, Kawasaki (JP); Masahiro Suzuki, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 93 days.

(21) Appl. No.: 13/644,834

(22) Filed: Oct. 4, 2012

(65) Prior Publication Data

US 2013/0089347 A1 Apr. 11, 2013

(30) Foreign Application Priority Data

Oct. 7, 2011 (JP) ..... 2011-223285

(51) Int. Cl.
*G03G 15/16* (2006.01)

(52) U.S. Cl.
CPC ..... *G03G 15/1605* (2013.01); *G03G 15/1675* (2013.01)

(58) Field of Classification Search
CPC ..... G03G 15/1605; G03G 15/1675; G03G 15/1645
See application file for complete search history.

(56) References Cited

U.S. PATENT DOCUMENTS 6,148,159 A * 11/2000 Shiraishi ..... 399/44
6,421,521 B2 * 7/2002 Tanaka ..... 399/299
7,228,085 B2 * 6/2007 Shin ..... 399/88
8,068,755 B2 * 11/2011 Kojima ..... 399/66
8,165,484 B2 * 4/2012 Murayama ..... 399/66
2011/0038645 A1 * 2/2011 Oh et al. ..... 399/37
2012/0177392 A1 * 7/2012 Murayama ..... 399/66

FOREIGN PATENT DOCUMENTS

JP 2-123385 A 5/1990
JP 2001-255761 A 9/2001
JP 2005-115064 A 4/2005
JP 2009-205013 A 9/2009
JP 2009205013 A * 9/2009

OTHER PUBLICATIONS

Michida, Sep. 2009, English (machine) translation.*

* cited by examiner

*Primary Examiner* — Billy Lactaoen
*Assistant Examiner* — Arlene Heredia Ocasio
(74) *Attorney, Agent, or Firm* — Fitzpatrick, Cella, Harper & Scinto

(57) ABSTRACT

An image forming apparatus includes a first image bearing member (drum); a second drum; a belt; a first transfer unit; a second transfer unit; a first voltage applying unit; a second voltage applying unit; a detecting unit, connected to the first transfer unit, for detecting a value of a current passing through the first voltage applying unit; and a controller for controlling the first voltage applying unit and the second voltage applying unit. The controller controls the first voltage applying unit during image formation on the basis of a detection result of the value of the current detected by the detecting unit at timing before and after the voltage applied to the second voltage applying unit is changed plural times before the image formation.

17 Claims, 7 Drawing Sheets

IMAGE FORMING APPARATUS CONTROLLING VOLTAGE APPLIED TO TONER TRANSFER UNITS

FIELD OF THE INVENTION AND RELATED ART

The present invention relates to an image forming apparatus, such as a printer or a copying machine, of an electrophotographic type or an electrostatic recording type. Specifically, the present invention relates to an image forming apparatus including a mechanism for transferring toner images from a plurality of image bearing members onto a toner image receiving member such as an intermediary transfer member or a toner image receiving material.

As a color image forming apparatus for the intermediary transfer member, a color printer of a tandem type in which image forming stations of colors of yellow, magenta, cyan and black and toner images of these colors are successively superposed is used. Hereinafter, these stations are referred to as a first station (yellow), a second station (magenta), a third station (cyan) and a fourth station (black).

An electric resistance of a primary transfer unit for transferring the toner image from a photosensitive member as the image bearing member onto the intermediary transfer member as the toner image receiving member varies depending on durability fluctuation and environment fluctuation. In order to prevent a deterioration of a transfer property due to the electric resistance fluctuation of the primary transfer unit and to apply a proper primary transfer voltage, a transfer voltage control is employed. For example, in a period after start of an image forming operation of the image forming apparatus and before start of intermediary transfer, constant-current control or constant-voltage control of a toner portion with a preset value (target value) with respect to a non-image portion on the photosensitive member. By a fluctuation in generated voltage value or generated current value at that time, the resistance fluctuation of the primary transfer unit is detected and on the basis of a processing result of the generated voltage value or the generated current value, an applied voltage is effected so that a certain current continuously passes through the primary transfer unit during image formation. Such transfer voltage control is referred to as ATVC (active transfer voltage (bias) control).

In the color image forming apparatus, in the case where an image of a single color, e.g., a black image is formed, an operation in a monochromatic mode in which the image forming stations other than the fourth station are stopped is executable. For example, in the case where a constant-current power source for the fourth station is turned on and those for other stations are turned off and then the fourth station is subjected to the ATVC, a part of the current supplied to the fourth station is leaked to between power source circuits and a protective member for the primary transfer unit. This current is referred to as a leakage current. The leakage current varies depending on the durability fluctuation or the environment fluctuation and therefore the proper electric resistance at the transfer portion cannot be measured, so that the ATVC is not effected normally and thus there was a possibility that improper transfer occurs.

Japanese Laid-Open Patent Application (JP-A) 2005-115064 discloses that another primary transfer unit adjacent to the primary transfer unit to be subjected to the ATVC is supplied with the same voltage at the same time to effect the ATVC while suppressing the contact, so that a proper transfer voltage can be determined.

According to JP-A 2005-115064, although the ATVC can be effected in a state in which the leakage current is suppressed, e.g., even in an operation in a mode such as the monochromatic mode in which only the fourth station is used for image formation, there arises need to apply the voltage to the adjacent third station also during image formation in the same state as that when the ATVC is effected.

However, in order to suppress durability deterioration of the photosensitive member, the intermediary transfer member and the primary transfer unit, it is desirable that no voltage is applied to a transfer portion which is not used during image formation. However, when the voltage is not applied to the adjacent station during image formation, the leakage current is generated and thus the resultant state is different from the state determined by effecting the ATVC, so that a current value of the fourth station is different from the target value. For that reason, there was a problem that the improper transfer is generated.

As described above, there arises a problem such that it is difficult to compatibly realize execution of accurate ATVC while suppressing the generation of the leakage current and suppression of durability deterioration of the transfer unit of the station other than the associated station in the operation in the monochromatic mode.

SUMMARY OF THE INVENTION

The above problems can be achieved by an image forming apparatus according to the present invention.

According to an aspect of the present invention, there is provided an image forming apparatus comprising: a first image bearing member for bearing a toner image; a second image bearing member for bearing a toner image; a movable belt; a first transfer unit for transferring the toner image from the first image bearing member onto the belt or a toner image receiving material conveyed by the belt; a second transfer unit for transferring the toner image from the second image bearing member onto the belt or the toner image receiving material; a first voltage applying unit for applying a voltage to the first transfer unit; a second voltage applying unit for applying a voltage to the second transfer unit; a detecting unit, connected to the first transfer unit, for detecting a value of a current passing through the first voltage applying unit; and a controller for controlling the first voltage applying unit and the second voltage applying unit, wherein the controller controls the first voltage applying unit during image formation on the basis of a detection result of the value of the current detected by the detecting unit at timing before and after the voltage applied to the second voltage applying unit is changed plural times before the image formation.

These and other objects, features and advantages of the present invention will become more apparent upon a consideration of the following description of the preferred embodiments of the present invention taken in conjunction with the accompanying drawings.

Figure 3:
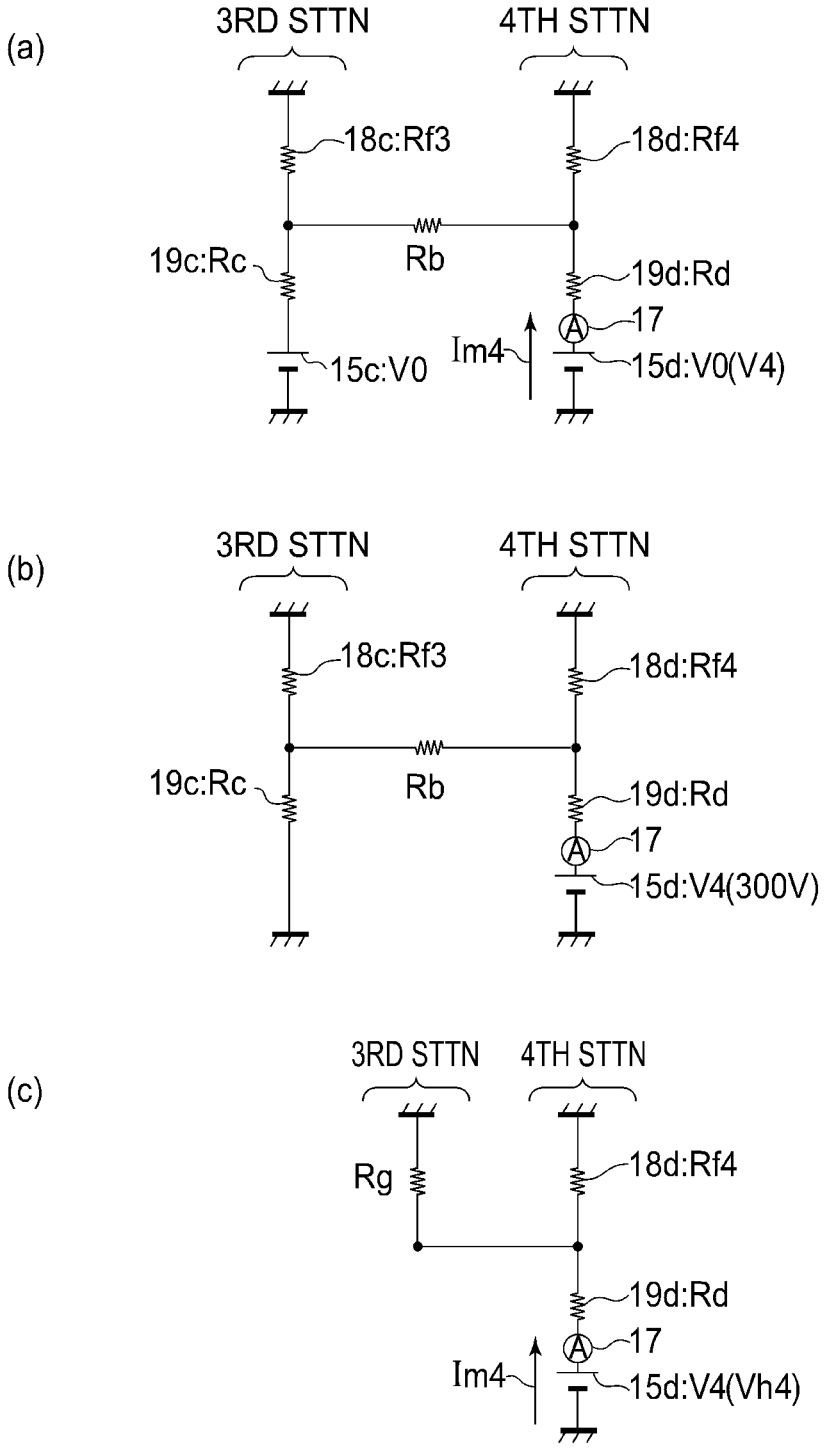

Parts (a), (b) and (c) of FIG. 3 are schematic views each for illustrating an operation of the image forming apparatus at a primary transfer portion in Embodiment 1.

Figure 4:
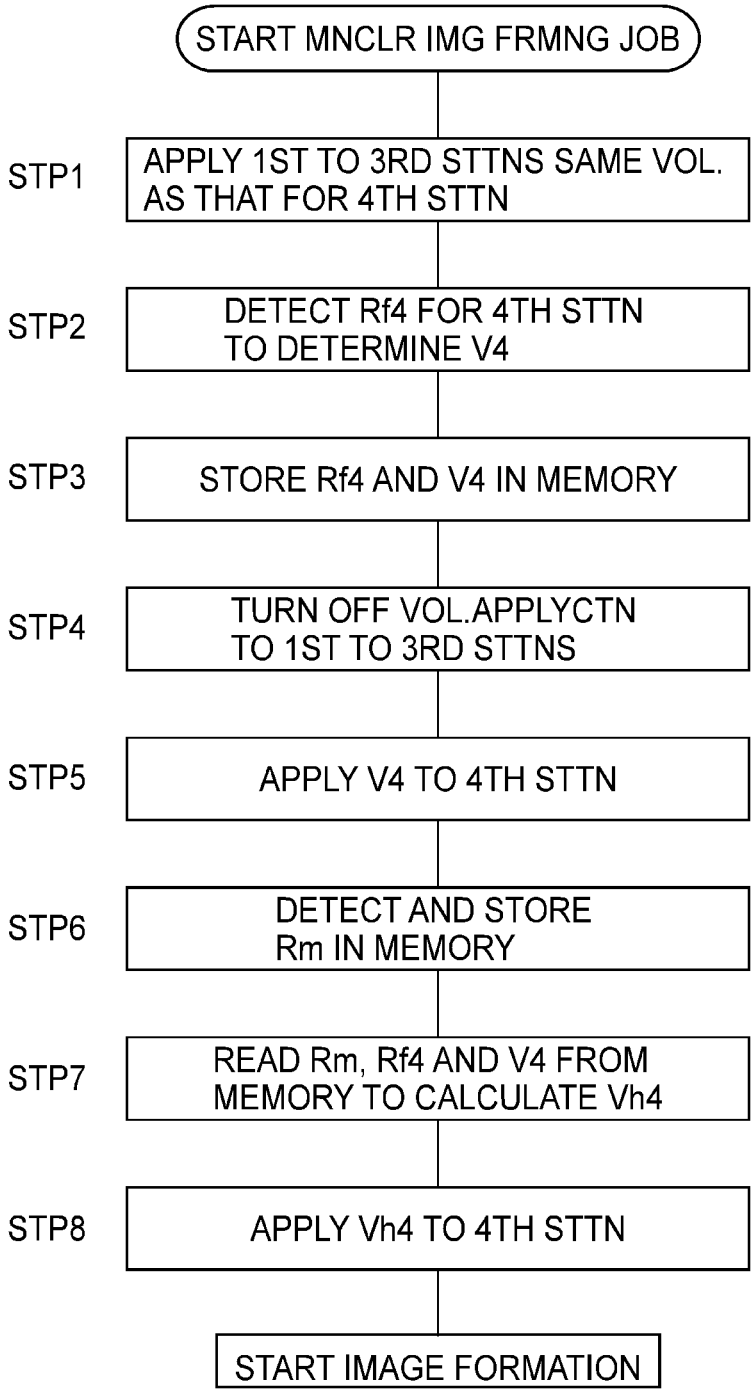

FIG. 4 is a flow chart for illustrating an operation of the image forming apparatus in Embodiment 1.

Figure 5:
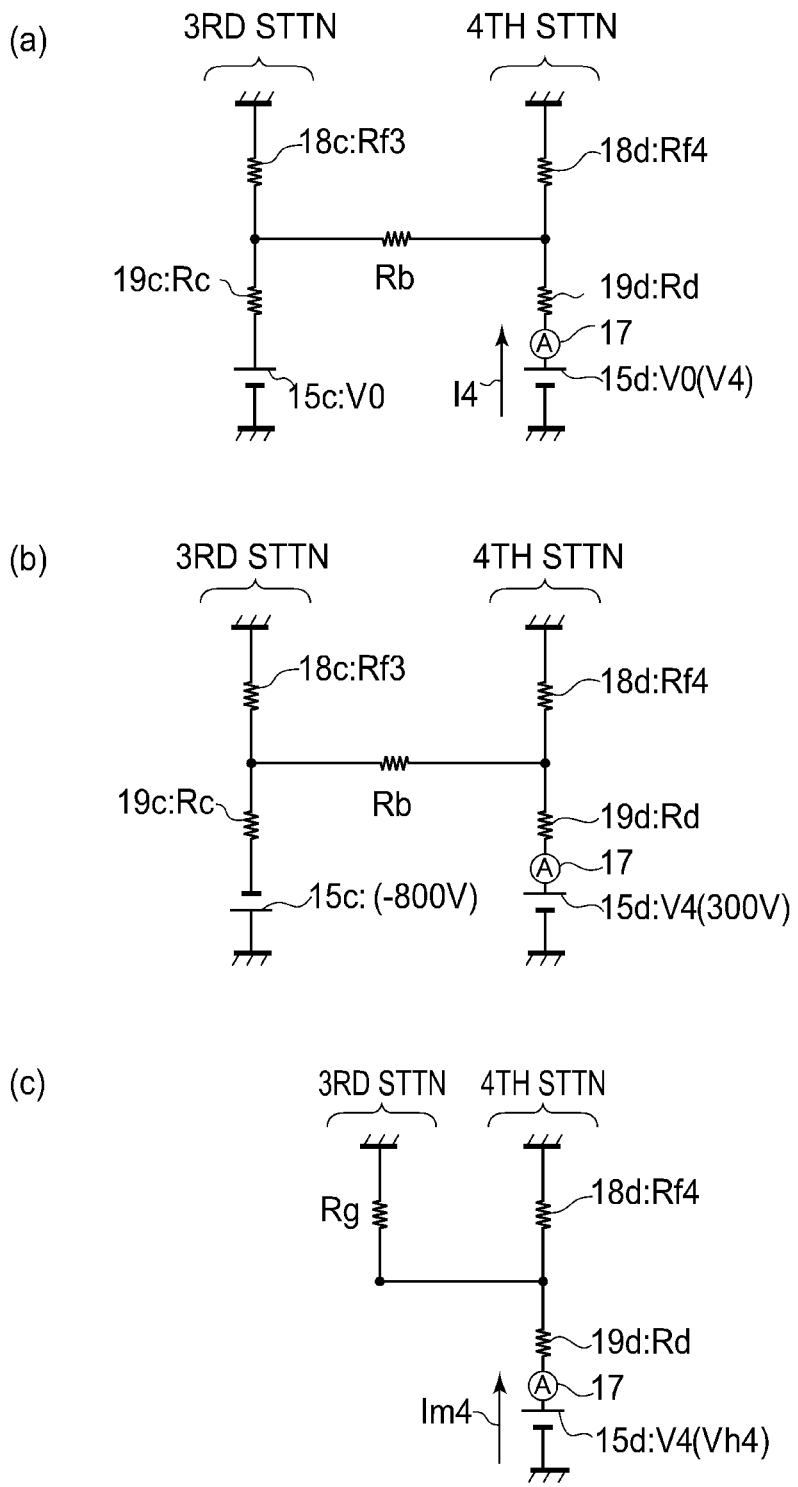

Parts (a), (b) and (c) of FIG. 5 are schematic views each for illustrating an operation of the image forming apparatus at a primary transfer portion in Embodiment 2.

Figure 6:
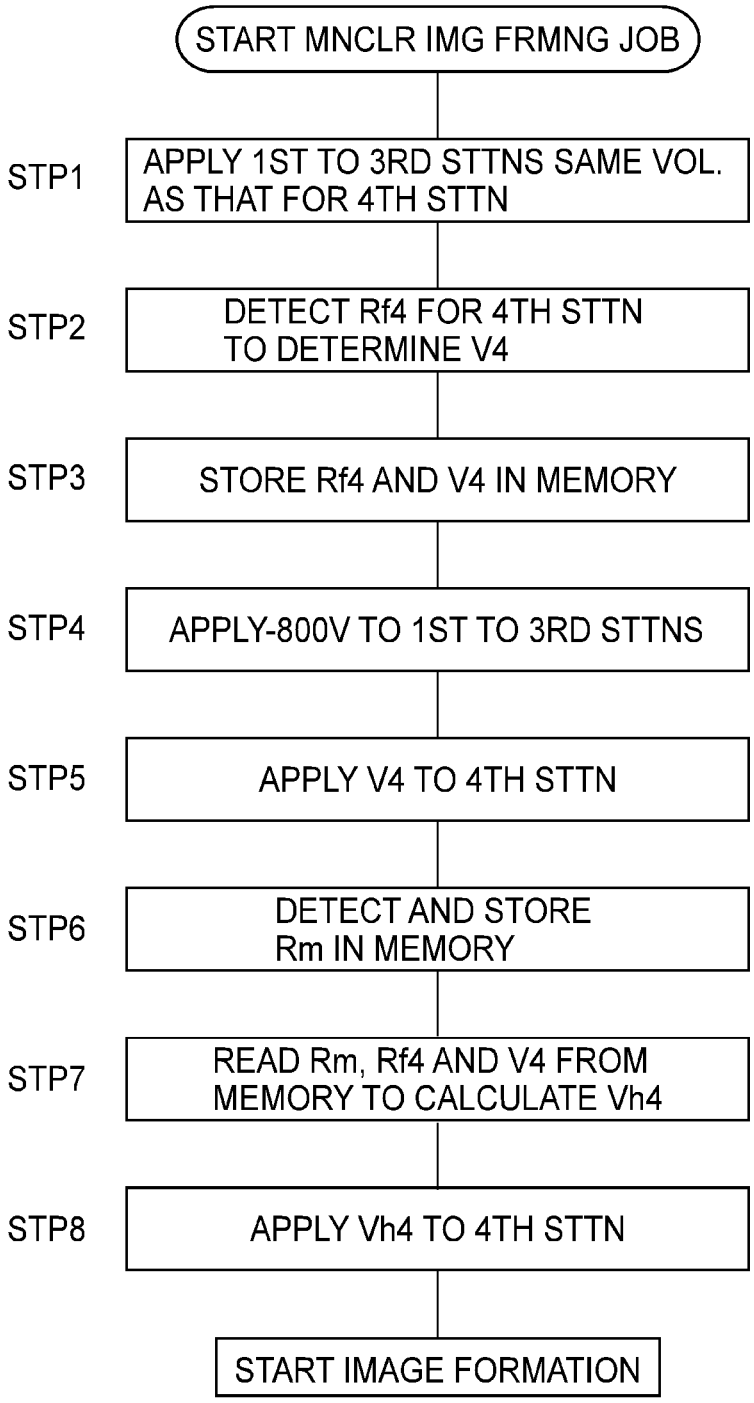

FIG. 6 is a flow chart for illustrating an operation of the image forming apparatus in Embodiment 2.

Figure 7:
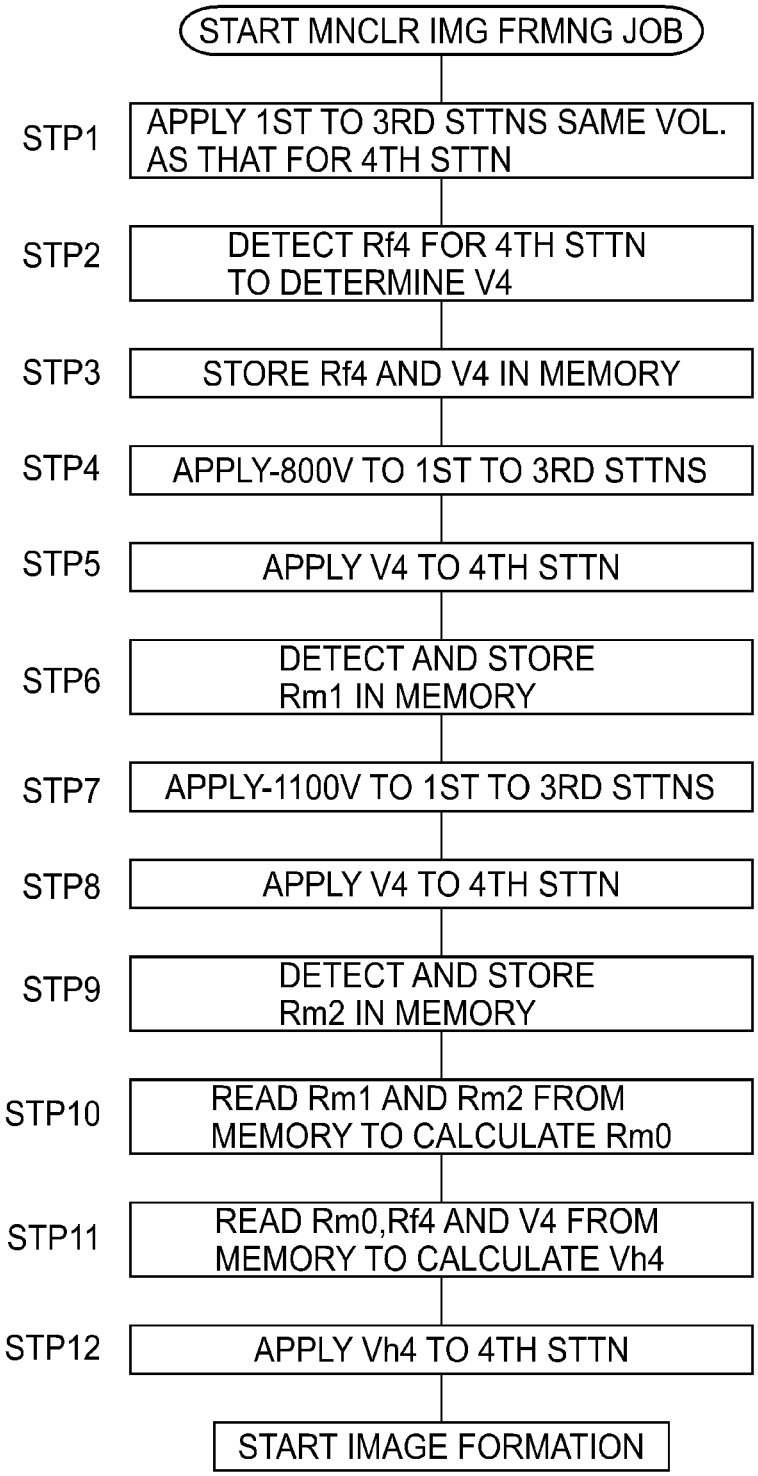

FIG. 7 is a flow chart for illustrating an operation of the image forming apparatus in Embodiment 3.

DESCRIPTION OF THE PREFERRED EMBODIMENTS

Hereinbelow, image forming apparatuses according to the present invention will be described in detail with reference to the drawings.

Embodiment 1

Figure 1:
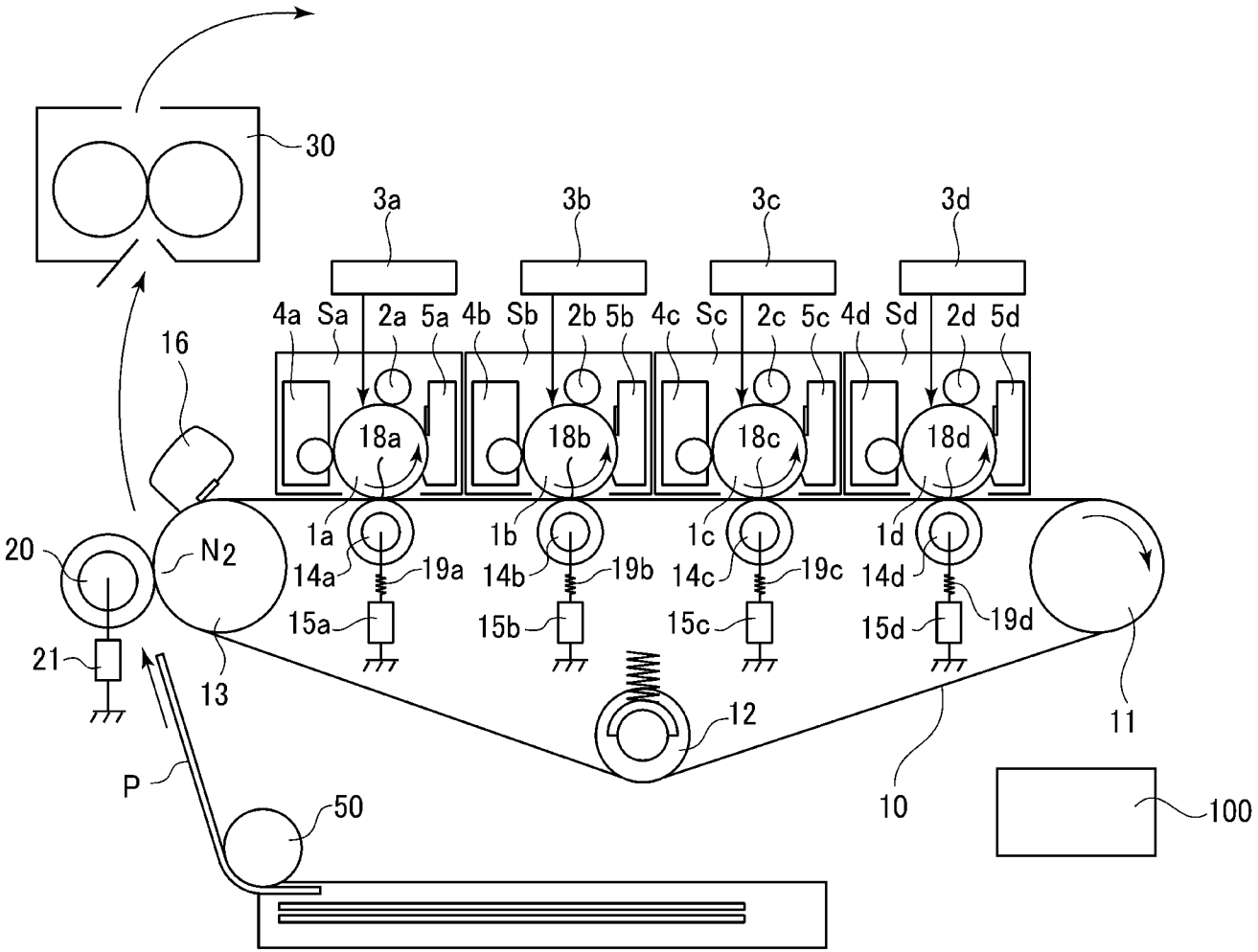
FIG. 1 is a schematic sectional view of an image forming apparatus according to the present invention in Embodiment 1.

FIG. 1 is a schematic structural view of an image forming apparatus according to the present invention in this embodiment, and a constitution and operation of the image forming apparatus will be described with reference to FIG. 1.

The image forming apparatus in this embodiment is a color printer of a tandem type in which image formation is effected by successively superposing toner images of a plurality of colors, four colors in this embodiment of yellow (Y), magenta (M), cyan (C) and black (Bk). The image forming apparatus includes four image forming stations consisting of a first station Sa for yellow (Y), a second station Sb for magenta (M), a third station Sc for cyan (C) and a fourth station Sd for black (Bk). The respective stations Sa to Sd have the same constitution and perform the same operation and therefore an image forming operation will be described by using the first station Sa.

(Operation of Image Forming Apparatus)

The first station Sa includes, as an image bearing member, an electrophotographic photosensitive member (hereinafter referred to as a photosensitive drum) 1*a*, and the photosensitive drum 1*a* is rotationally driven in an arrow direction at a predetermined peripheral speed (process speed).

The photosensitive drum 1*a* is, during this rotation process, electrically charged to a predetermined polarity and a predetermined potential by a charging roller 2*a* and then is imagewise exposed to light by an imagewise exposure unit 3*a*. As a result, an electrostatic latent image corresponding to a yellow component image for an objective color image is formed. Then, the electrostatic latent image is developed at a developing position by a first developing device (yellow developing device) 4*a* to be visualized as a yellow toner image.

An intermediary transfer belt 10 as an intermediary transfer member is a movable belt and is stretched by rollers 11, 12 and 13 as a stretching member, and is rotationally driven, at an opposing portion where it contacts the photosensitive drum 1*a*, in the same direction as that of the photosensitive drum 1*a* at the substantially same peripheral speed as that of the photosensitive drum 1*a*. The yellow toner image formed on the photosensitive drum 1*a* is transferred onto the intermediary transfer belt 10 as a toner image receiving member during passing thereof through a contact portion (primary transfer portion) between the photosensitive drum 1*a* and the intermediary transfer belt 10 (primary transfer). At this time, to a primary transfer roller 14*a* as a transfer unit, a primary transfer voltage is applied from a primary transfer power source 15*a* as a voltage applying unit. A primary transfer residual toner remaining on the surface of the photosensitive drum 1*a* is removed by a cleaning device 5*a* and thereafter the photosensitive drum 1*a* is subjected to an image forming process starting from the above-described charging step.

Then, in a similar manner, a magenta (second color) toner image, a cyan (third color) toner image and a black (fourth color) toner image are formed at other stations Sb, Sc and Sd, respectively, and are successively transferred superposedly onto the intermediary transfer belt 10, so that a synthetic color image corresponding to an objective color image is obtained.

The fourth color toner images on the intermediary transfer belt 10 are, during passing thereof through a secondary transfer portion N2 between the intermediary transfer belt 10 and a secondary transfer roller 20, collectively transferred onto a surface of a toner image receiving material (transfer material) P fed by a sheet feeding means 50 (secondary transfer). At this time, to the secondary transfer roller 20, a secondary transfer voltage is applied by a secondary transfer power source 21. Thereafter, the toner image receiving material P on which the four color toner images are carried is introduced into a fixing device 30, in which the four color toners (toner images) are melt-mixed under heating and pressure and are fixed on the toner image receiving material P.

By the above operation, a full-color print image is formed. Further, a secondary transfer residual toner remaining on the surface of the intermediary transfer belt 10 is collected and removed by a blade 16.

(Transfer Constitution)

The intermediary transfer belt 10 is an endless belt to which electroconductivity is imparted by adding an electroconductive material to a resin material and is stretched by three shafts of a driving roller 11, a tension roller 12 and a secondary transfer opposite roller 13, thus being stretched under a tension of 60 N in totally by the tension roller 12.

Each of the primary transfer rollers 14*a* to 14*d* is prepared in an outer diameter of 12 mm by coating a nickel-plated steel rod having an outer diameter of 6 mm with a foam sponge member which is formed principally of NBR and epichlorohydrin rubber and is adjusted to have a volume resistivity of $10^7$ Ω·cm and a thickness of 3 mm. Each of the primary transfer rollers 14*a* to 14*d* is contacted to the intermediary transfer belt 10 toward the associated one of the photosensitive drums 1*a* to 1*d* under pressure of 9.8 N, thus being rotated by the rotation of the intermediary transfer belt 10. Further, between the primary transfer rollers 14*a* to 14*d* and the primary transfer power sources 15*a* to 15*d*, electric resistors having protective resistance values R (Ra to Rd), i.e., load resistors (protective resistors) 19*a* to 19*d* are provided. These protective resistors are provided in order to stabilize a partial potential applied to the primary transfer portion (primary transfer portion potential).

Figure 2:
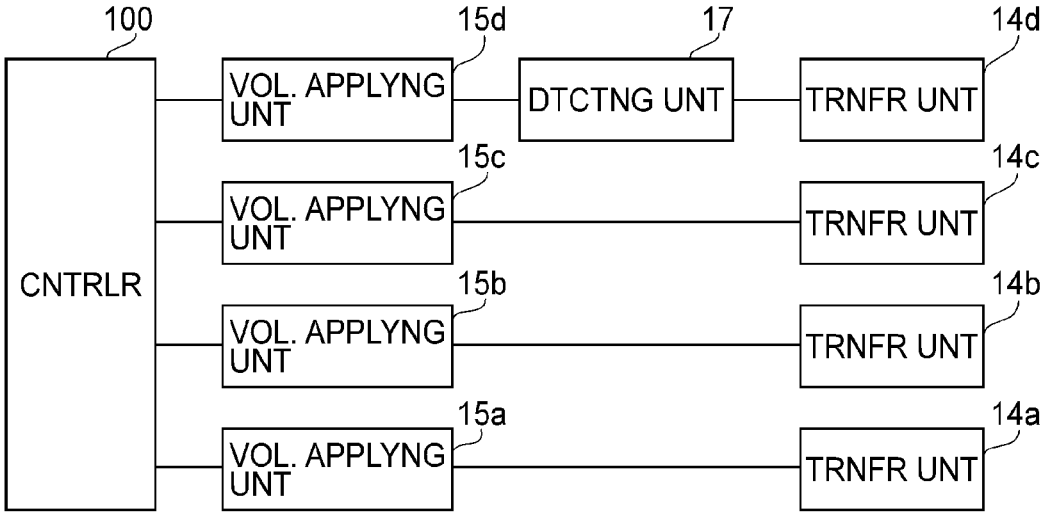
FIG. 2 is a block diagram showing a relationship between a controller of the image forming apparatus and units consisting of voltage applying units, a detecting unit and transfer units.

In this embodiment, in the 4-drum constitution as described above, a controller 100 provided in the image forming apparatus main assembly controls the primary transfer power sources 15*a* to 15*d* so that an optimum voltage can be applied by correcting the environment fluctuation and resistance non-uniformity of the intermediary transfer belt 10 and the primary transfer rollers 14*a* to 14*d* in the control of the primary transfer voltage. FIG. 2 is a block diagram for illustrating a relationship among the controller 100, the primary transfer power sources (voltage applying units) 15*a* to 15*d*, a detecting unit 17 connected to the primary transfer power sources 15*a* to 15*d*, and the transfer units 14*a* to 14*d*. The controller 100 contacts each of the primary transfer power sources 15*a* to 15*d* to apply a voltage to each of the primary transfer rollers 14*a* to 14*d*. At that time, the detecting unit 17 detects a value of a current passing through the connected primary transfer roller 14*d*.

In this embodiment, an ammeter 17 for detecting the value of the current passing through the primary transfer roller 14*d* is used. In this embodiment, the controller 100 employs the ATVC so that the optimum voltage can be applied.

The ATVC is the transfer voltage control system as described above. That is, in the ATVC, in a period after start of the image forming operation of the image forming apparatus and before start of intermediary transfer, the controller 100 effects constant-current control with a preset value, i.e., a target value at the primary transfer portion on the non-image portion of the photosensitive drum. Then, by a generated voltage value, the resistance fluctuation of the primary transfer unit is estimated and on the basis of a result of processing of a preceding generated voltage value, an applied voltage is controlled during image formation so that a constant current can continuously pass through the primary transfer portion.

During monochromatic image formation, it is desirable that no voltage if applied, during image formation in order to suppress durability deterioration, to the photosensitive drums 1*a* to 1*c* and the primary transfer rollers 14*a* to 14*c* at the image forming stations Sa to Sc, where the image formation is not effected, other than the fourth station Sd. In this case, a potential difference between the fourth station Sd and the adjacent third station Sc, i.e., a potential difference during image formation is conspicuously generated, so that a leakage current is generated from the fourth station Sd. Therefore, even when the ATVC is effected in a state in which the contact is suppressed and then a transfer power source voltage is determined, the leakage current is generated during image formation and thus there is a possibility that the value of the voltage actually applied to the primary transfer portion 18*d* is deviated from a proper value and thus improper transfer is generated.

In this embodiment, an operation in an image forming mode in which the image formation is effected by applying the transfer voltage to the fourth station Sd during image formation without applying the transfer voltage to other (first to third) stations Sa to Sc is executed. The operation of the primary transfer portion 18*d* in this image forming mode will be described.

That is, in the image forming mode as in this embodiment, during the monochromatic image formation, the voltage is not applied to the transfer rollers 14*a*, 14*b* and 14*c* at the first, second and third stations, Sa, Sb and Sc. Therefore, in this case, a primary transfer portion voltage value at the time when the ATVC is effected at the fourth station Sd and a primary transfer portion voltage value during image formation are largely different from each other. This will be described with reference to (a) to (c) of FIG. 3 as an example.

Referring to (a) of FIG. 3, in a state in which the same voltage as that applied at the fourth station Sd is applied to the first and second stations Sa and Sb and an illustrated third station Sc, the ATVC is effected at the fourth station Sd. The transfer power source voltage as an obtained result is V1 and the primary transfer portion voltage at that time is Vf. However, when the image forming apparatus is placed in an image forming state by using the transfer power source V, the potential difference is generated between the fourth station Sd and other stations Sa to Sc, so that the leakage current passes from the fourth station Sd through other stations Sa to Sc principally via the intermediary transfer belt 10. This constitution is simplified as shown in (c) of FIG. 3, so that an apparent impedance of the primary transfer portion 18*d* is changed and thus the primary transfer portion voltage value differs from that during the ATVC. Therefore, in order to correct an amount of the difference (deviation) in primary transfer portion voltage value, there is a need to set the transfer power source V.

Hereinafter, control unit before the image formation is started in this embodiment will be described along a flow chart shown in FIG. 4 as an example.

First, in step 1, the controller 100 applies the same voltage V0 to all the stations Sa to Sd, i.e., applied the same voltage V0, as that applied to the fourth station Sd, to the first to third station Sa to Sc ((a) of FIG. 3). As a result, in a state in which the leakage current from the fourth station Sd to other stations Sa to Sc is not generated, constant current control with a read value I4=5.0 μA of the ammeter (detecting means) 17 shown in (a) of FIG. 3 is effected. Then, in step 2, the controller 100 detects impedance Rf4 of the primary transfer portion 18*d* of the fourth station Sd and determines a primary transfer power source V4 necessary to form the image at the fourth station Sd. In this embodiment, Rf4 was 20 MΩ and V4 was 200 V.

Then, in step 3, the primary transfer power source voltage V4 obtained in the step 2 is stored in an unshown memory.

Then, in step 4, similarly as during image formation, the controller places the image forming apparatus in the state in which the voltage V4 is applied to the fourth station Sd but no voltage is applied to the first, second and third stations Sa, Sb and Sc ((b) of FIG. 3). Then, as shown in (c) of FIG. 3, in step 5, the voltage V4 is applied, so that a current value Im during image formation in which the leakage current from the fourth station Sd is generated from the fourth station Sd is detected by the ammeter 17 and then the controller 100 calculates a synthetic impedance (apparent impedance) Rm of the impedance Rf4 of the fourth station Sd and a synthetic resistance Rg. The controller 100 stores the calculated synthetic impedance Rm in an unshown memory in step 6. In this embodiment, Rm was 3.81 MΩ.

In step 7, the controller 100 retrieves detection results of the ATVC in the steps 3 and 6 from the memory and calculates the primary transfer power source voltage value Vh4 at the fourth station Sd so that a value of the voltage applied to the synthetic impedance Rm is almost equal to Vf4. A calculation formula in this embodiment can be derived from the following relational expressions (1), (2), (3) and (4).

$$Vf4=V4-I4\times Rd=V4\times Rf4/(Rd+Rf4) \quad (1)$$

Vf4: primary transfer portion voltage in step 2
I4: 5.0 μA
Rd: 20 MΩ (protective resistance value)

$$V4=Im\times(Rd+Rm) \quad (2)$$

Im=8.4 μA: read value of ammeter in step 5

$$Vm4=Vh4\times Rm/(Rd+Rm) \quad (3)$$

Vm4: primary transfer portion voltage value in step 6

$$Vf4=Vm4 \quad (4)$$

From the expressions (1), (2), (3) and (4), Vh4 is represented by the following equation.

$$Vh4 = V4\times(V4 - I4\times Rd)/(V4 - Im\times Rd)$$
$$= V4\times Rf4(Rm - Rd)/Rm(Rf4 + Rd)$$

From the above equation, a result of Vh4=640 V is obtained.

In step 8, the controller 100 applies Vh4=640 V to the primary transfer power source 15*d* of the fourth station Sd, thus starting the image formation.

That is, according to this embodiment, the voltages are applied to the transfer roller 14*d* and other transfer rollers 14*a* to 14*c* so that an absolute value of the potential difference generated when the voltages are applied to the transfer roller 14*d* and other transfer rollers 14*a* to 14*c* before the image formation is smaller than an absolute value of that during image formation.

Further, the transfer power source voltage applied to the transfer roller 14*d* and other transfer rollers 14*a* to 14*c* can be calculated as described above by using a detection result of the impedance (Rf4) of the transfer roller 14*d*, a detection result of the impedance (Rm) of the transfer roller 14*d* during image formation and the resistance value (Rd) of the electric resistor 19*d* when the voltage (V4) is applied to the transfer roller 14*d* and other transfer rollers 14*a* to 14*c*.

By employing such a constitution, in this embodiment, the primary transfer portion voltage can be corrected to a proper value.

In this embodiment, the system in which the constant-current control is effected to detect the resistance fluctuation and then the transfer voltage is controlled by the constant-voltage control was described. However, the present invention is not limited to this system but may also employ a system in which the constant-current control is effected to detect the resistance fluctuation and then the transfer voltage is controlled by the constant-current control.

As described above, according to the present invention, the image forming apparatus includes the plurality of image forming station Sa to Sd where the photosensitive drums 1*a* to 1*d* are provided, respectively, and the toner images are formed on the photosensitive drums 1*a* to 1*d*. The toner images are transferred from the photosensitive drums 1*a* to 1*d* onto the intermediary transfer belt 10 as the toner image receiving member by the transfer rollers 14*a* to 14*d* to which the transfer voltages are applied from the transfer power sources 15*a* to 15*d*, respectively.

The transfer roller 14*d* of the fourth station Sd, the detecting unit including the ammeter 17 or the like for detecting the voltage or the current for the transfer voltage applied from the transfer power source 15*d* is connected. When the operation in the monochromatic mode is executed, the image is formed at only the fourth station Sd.

According to the present invention, in such a constitution, before the image formation, the voltage applied to transfer means other than the transfer roller 14*d* as the transfer means to which the detecting means is connected, i.e., the transfer rollers 14*a* to 14*c* is changed plural times, and then the voltage and/or the current for the transfer roller 14*d* before and after the changes is detected. From this detection result, the voltage or the current to be applied to the transfer roller 14*d* to be subjected to the image formation is determined.

Therefore, according to the present invention, it becomes possible to compatibly realize execution of accurate ATVC in which the leakage current is prevented and suppression of the durability deterioration of the transfer portions other than the transfer portion at the associated station during the operation in the monochromatic image forming mode.

Embodiment 2

In this embodiment, an operation of the primary transfer portion 18*d* when image formation is effected under application of a voltage to the transfer roller 14*d* of the fourth station and under application of a voltage to the transfer rollers 14*a* and 14*c* of other (first to third) stations Sa to Sc during image formation.

That is, in an operation in an image forming mode as in this embodiment, during monochromatic image formation, the photosensitive drums 1*a* to 1*c* of the stations Sa to Sc other than the fourth station Sd, where the image formation is not effected are electrically charged. This is because a single high charge voltage is used for reducing a cost and the voltage is applied also to the charging means of the first to third image forming stations Sa to Sc which are not subjected to the image formation.

In this case, a potential difference is generated between the primary transfer rollers 14*a* to 14*c* and the photosensitive drums 1*a* to 1*c*, so that a current passes through the primary transfer rollers 14*a* to 14*c* and the photosensitive drums 1*a* to 1*c* and thus there is a possibility that durability of these members is deteriorated.

Therefore, in this embodiment, an embodiment capable of applying a proper transfer voltage while suppressing durability deterioration without carrying the current through the primary transfer rollers 14*a* to 14*c* and the photosensitive drums 1*a* to 1*c* is proposed.

In the image forming apparatus in this embodiment, the same constitution as that of the image forming apparatus described with reference to FIG. 1 in Embodiment 1 is employed and therefore the constitution and operation of the image forming apparatus in this embodiment will be omitted from description.

Hereinafter, control in this embodiment will be described with reference to simple circuit diagrams shown in (a) to (c) of FIG. 5 and along a flow chart shown in FIG. 6 as an example.

First, in step 1, the same voltage V0 is applied to all the stations Sa to Sd, i.e., the same voltage V0 as that applied to the fourth station Sd is applied to the first to third stations Sa to Sc ((a) of FIG. 5). As a result, in a state in which the leakage current from the fourth station Sd to other stations Sa to Sc is not generated, constant current control with a read value 14=5.0 μA is effected. Then, in step 2, an impedance Rf4 of the primary transfer portion 18*d* of the fourth station Sd is detected and a primary transfer power source V4 necessary to form the image at the fourth station Sd is determined. In this embodiment, Rf4 was 20 MΩ and V4 was 200 V.

Then, in step 3, the primary transfer power source voltage V4 obtained in the step 2 is stored in an unshown memory.

Then, in step 4, a voltage of −800 V is applied to the transfer rollers 14*a* to 14*c* of the first, second and third stations Sa, Sb and Sc ((b) of FIG. 5). In this embodiment, also the photosensitive drums 1*a*, 1*b* and 1*c* are charged to −800 V, so that no potential difference is generated between the photosensitive drum 1*c* and the primary transfer roller 14*c*. However, a difference in applied voltage between the fourth station Sd and other stations Sa to Sc is 1100 V, so that the leakage current is generated.

In step 5, the voltage V4 is applied, so that a synthetic impedance (apparent impedance) Rm of the impedance Rf4 of the fourth station Sd and a synthetic resistance Rg during image formation in which the leakage current from the fourth station Sd is generated from the fourth station Sd is calculated ((c) of FIG. 5). Then, the calculated synthetic impedance Rm is stored in an unshown memory in step 6. In this embodiment, Rm was 1.98 MΩ.

In step 7, detection results of the ATVC in the steps 3 and 6 are retrieved form the memory and then the primary transfer power source voltage value Vh4 at the fourth station Sd is calculated so that a value of the voltage applied to the synthetic impedance Rm is almost equal to Vf4. A calculation formula in this embodiment can be derived from the following relational expressions (1), (2), (3) and (4).

$$Vf4=V4-I4\times Rd=V4\times Rf4/(Rd+Rf4) \quad (1)$$

Vf4: primary transfer portion voltage in step 2
I4: 5.0 μA
Rd: 20 MO (protective resistance value)

$$V4=Im\times(Rd+Rm) \quad (2)$$

Im=9.1 μA: read value of ammeter in step 5

$$Vm4=Vh4\times Rm/(Rd+Rm) \quad (3)$$

Vm4: primary transfer portion voltage value in step 6

$$Vf4=Vm4 \quad (4)$$

From the expressions (1), (2), (3) and (4), Vh4 is represented by the following equation.

$$Vh4 = V4\times(V4 - I4\times Rd)/(V4 - Im\times Rd)$$
$$= V4\times Rf4(Rm - Rd)/Rm(Rf4 + Rd)$$

From the above equation, a result of Vh4=1100 V was obtained.

In step 8, Vh4=1100 V is applied to the primary transfer power source 15*d* of the fourth station Sd, so that the image formation is started.

That is, according to this embodiment, the voltages are applied to the transfer roller 14*d* and other transfer rollers 14*a* to 14*c* so that an absolute value of the potential difference generated when the voltages are applied to the transfer roller 14*d* and other transfer rollers 14*a* to 14*c* before the image formation is smaller than an absolute value of that during image formation.

Further, the transfer power source voltage applied to the transfer roller 14*d* and other transfer rollers 14*a* to 14*c* can be calculated as described above by using a detection result of the impedance (Rf4) of the transfer roller 14*d*, a detection result of the impedance (Rm) of the transfer roller 14*d* during image formation and the resistance value (Rd) of the electric resistor 19*d* when the voltage (V4) is applied to the transfer roller 14*d* and other transfer rollers 14*a* to 14*c*.

By employing such a constitution, in this embodiment, the primary transfer portion voltage can be corrected to a proper value. Also in this embodiment, it is possible to employ the same modified embodiment as in Embodiment 1 and it is possible to achieve the same functional effect as that described in Embodiment 1.

Embodiment 3

When the potential difference between the fourth station Sd and other stations Sa to Sc is large, depending on an operation environment, the leakage current is not changed linearly with respect to the potential difference in some cases. Thus, in the case where the apparent impedance Rm has voltage dependency, in order to enhance accuracy of ATVC, there is a need to perform many operations of the ATVC. In this embodiment, in order to further enhance the accuracy of the ATVC in the constitution in Embodiment 2, control in which the ATVC is effected three times is proposed.

In the image forming apparatus in this embodiment, the same constitution as that of the image forming apparatus described with reference to FIG. 1 in Embodiment 1 is employed and simple circuits of the third and fourth stations Sc and Sd are the same in constitution as those described with reference to (a) to (c) of FIG. 5 in Embodiment 2, and therefore the constitutions in this embodiment will be omitted from description.

Hereinafter, control in this embodiment will be described along a flow chart shown in FIG. 7 as an example.

First, in step 1, the same voltage V0 is applied to all the stations Sa to Sd, i.e., the same voltage V0 as that applied to the fourth station Sd is applied to the first to third stations Sa to Sc ((a) of FIG. 5). As a result, in a state in which the leakage current from the fourth station Sd to other stations Sa to Sc is not generated, constant current control with a read value 14=5.0 μA is effected. Then, in step 2, primary transfer portion impedance Rf4 of the fourth station Sd is determined and a primary transfer power source V4 necessary to form the image at the fourth station Sd is determined. In this embodiment, Rf4 was 20 MΩ and V4 was 200 V.

Then, in step 3, the primary transfer power source voltage V4 obtained in the step 2 is stored in an unshown memory.

Then, in step 4, a voltage of −800 V is applied to the transfer rollers 14*a* to 14*c* of the first, second and third stations Sa, Sb and Sc ((b) of FIG. 5). In this embodiment, also the photosensitive drums 1*a*, 1*b* and 1*c* are charged to −800 V, so that no potential difference is generated between the photosensitive drum 1*c* and the primary transfer roller 14*c*. However, a difference in applied voltage between the fourth station Sd and other stations Sa to Sc is 1100 V, so that the leakage current is generated.

In step 5, the voltage V4 is applied, so that a synthetic impedance (apparent impedance) Rm of the impedance Rf4 of the fourth station Sd and a synthetic resistance Rg when the voltage of −800 V is applied to the first to third stations Sa to Sc is calculated. Then, the calculated synthetic impedance Rm is stored in an unshown memory in step 6. In this embodiment, Rm1 was 1.67 MΩ.

In this embodiment, also the photosensitive drums 1*a*, 1*b* and 1*c* are charged to −800 V, so that no potential difference is generated between the photosensitive drum 1*c* and the primary transfer roller 14*c*. However, a difference in applied voltage between the fourth station Sd and other stations Sa to Sc is 1100 V, so that the leakage current is generated.

There is a possibility of the voltage dependency of the resistance value and therefore in step 7, the voltage of −1100 V is applied to the first to third stations Sa to Sc. The step 8, the voltage V4 is applied to the fourth station Sd. Then, in step 9, synthetic impedance (apparent impedance) Rm2 of the impedance Rf4 and the synthetic resistance Rg is calculated and stored in an unshown memory. In this embodiment, Rm2 was 1.17 MΩ.

In step 10, synthetic impedance detection results Rm1 and Rm2 in the steps 6 and 9 are retrieved from the memory, and average synthetic impedance Rm0 of Rm1 and Rm2 is calculated and stored in the memory. This calculation result was 1.42 MΩ.

In step 11, detection results of the ATVC in the steps 3 and 10 are retrieved form the memory and then the primary transfer power source voltage value Vh4 at the fourth station Sd is calculated so that a value of the voltage applied to the synthetic impedance Rm0 is almost equal to Vf4. A calculation formula in this embodiment can be derived from the following relational expressions (1), (2), (3) and (4).

$$Vf4=V4-I4\times Rd=V4\times Rf4/(Rd+Rf4) \quad (1)$$

Vf4: primary transfer portion voltage in step 2
I4: 5.0 μA
Rd: 20 MΩ (protective resistance value)

$$V4=Im0\times(Rd+Rm0) \quad (2)$$

Im0=9.34 uA: average of ammeter read values in steps 3 and 10

$$Vm4=Vh4\times Rm0/(Rd+Rm0) \quad (3)$$

Vm4: primary transfer portion voltage value in step 11

$$Vf4=Vm4 \quad (4)$$

From the expressions (1), (2), (3) and (4), Vh4 is represented by the following equation.

$$Vh4 = V4\times(V4 - I4\times Rd)/(V4 - Im0\times Rd)$$

$$= V4\times Rf4(Rm0 - Rd)/Rm0(Rf4 + Rd)$$

From the above equation, a result of Vh4=1508 V was obtained.

In step 12, Vh4=1508 V is applied to the primary transfer power source 15*d* of the fourth station Sd, so that the image formation is started.

As is understood from the above description, in this embodiment, the primary transfer portion voltage can be corrected to a proper value with high accuracy. Also in this embodiment, it is possible to employ the same modified embodiment as in Embodiments 1 and 2 and it is possible to achieve the same functional effect as that described in Embodiments 1 and 2.

In the above-described embodiments, the present invention was described as the image forming apparatus of the intermediary transfer type in which the toner image is once transferred onto the intermediary transfer member provided as the toner image receiving member and then is transferred from the intermediary transfer member onto the toner image receiving material. The present invention is not limited to the image forming apparatus having this constitution but may also be an image forming apparatus of the type in which the toner image is directly transferred from the photosensitive drum onto the toner image receiving material as the toner image receiving member to be conveyed by a toner image receiving material conveying means. A constitution of such an image forming apparatus is well known by a person skilled in the art and therefore will be omitted from further detailed description.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 223285/2011 filed Oct. 7, 2011, which is hereby incorporated by reference.

What is claimed is:

1. An image forming apparatus comprising:

a first image bearing member for bearing a toner image;

a second image bearing member for bearing a toner image;

a movable belt;

a first transfer unit for transferring the toner image from said first image bearing member onto said belt or a toner image receiving material conveyed by said belt;

a second transfer unit for transferring the toner image from said second image bearing member onto said belt or the toner image receiving material;

a first voltage applying unit for applying a voltage to said first transfer unit;

a second voltage applying unit for applying a voltage to said second transfer unit;

a detecting unit, connected to said first transfer unit, for detecting a value of a current passing through said first voltage applying unit; and a controller for controlling said first voltage applying unit and said second voltage applying unit, wherein said controller controls said first voltage applying unit so that a transfer voltage is applied from said first voltage applying unit to said first transfer unit during image formation on the basis of a first detection result of said detecting unit detected in a state in which the same voltage is applied from said first and second voltage applying units to said first and second transfer units, respectively, and on the basis of a second detection result of said detecting unit detected in a state in which a first voltage is applied from said first voltage applying unit to said first transfer unit and voltage application from said second voltage applying unit is stopped, and wherein the first voltage has the same polarity and the same absolute value as the same voltage.

2. An image forming apparatus according to claim 1, wherein between said first transfer unit and said first voltage applying unit, a predetermined electric resistor is provided.

3. An image forming apparatus according to claim 2, wherein between said second transfer unit and said second voltage applying unit, a second predetermined electric resistor is provided.

4. An image forming apparatus according to claim 1, wherein said controller determines the first voltage from a detection result of said detecting unit at the time when the same voltage is applied to said first and second transfer units by said first and second voltage applying units before the image formation and thereafter contacts said first and second transfer units so that the first voltage is applied to said first transfer unit by said first voltage applying unit and so that no voltage is applied to said second transfer unit by said second voltage applying unit.

5. An image forming apparatus according to claim 1, wherein said controller detects a voltage to be applied to said first transfer unit during image formation from a detection result of said detecting unit in a state in which the first voltage is applied to said first transfer unit by said first voltage applying unit and no voltage is applied to said second transfer unit by said second voltage applying unit.

6. An image forming apparatus according to claim 1, wherein said controller applies no voltage from said second voltage applying unit to said second transfer unit during image formation.

7. An image forming apparatus according to claim 1, wherein said first image bearing member is provided downstream of said second image bearing member with respect to a movement direction of said belt.

8. An image forming apparatus according to claim 6, wherein said second transfer unit contacts said belt during image formation under application of the transfer voltage from said first voltage applying unit to said first transfer unit.

9. An image forming apparatus according to claim 1, wherein said controller determines a first voltage from a detection result of said detecting unit at the time when the same voltage is applied to said first and second transfer units by said first and second voltage applying units before the image formation and thereafter contacts said first and second transfer units so that the first voltage is applied to said first transfer unit by said first voltage applying unit and so that a voltage of an opposite polarity to that of the first voltage is applied to said second transfer unit by said second voltage applying unit.

10. An image forming apparatus according to claim 1, wherein said controller is capable of executing an operation in a monochromatic mode in which the toner image is transferred from only said first image bearing member, and wherein when said controller executes the operation in the monochromatic mode, the transfer voltage is applied to said first transfer unit.

11. An image forming apparatus comprising:

a first image bearing member for bearing a toner image;

a second image bearing member for bearing a toner image;

a movable belt;

a first transfer unit for transferring the toner image from said first image bearing member onto said belt or a toner image receiving material conveyed by said belt;

a second transfer unit for transferring the toner image from said second image bearing member onto said belt or the toner image receiving material;

a first voltage applying unit for applying a voltage to said first transfer unit;

a second voltage applying unit for applying a voltage to said second transfer unit;

a detecting unit, connected to said first transfer unit, for detecting a value of a current passing through said first voltage applying unit; and a controller for controlling said first voltage applying unit and said second voltage applying unit, wherein said controller controls said first voltage applying unit so that a transfer voltage is applied from said first voltage applying unit to said first transfer unit during image formation on the basis of a first detection result of said detecting unit detected in a state in which the same voltage is applied from said first and second voltage applying units to said first and second transfer units, respectively, and on the basis of a second detection result of said detecting unit detected in a state in which a first voltage is applied from said first voltage applying unit to said first transfer unit and a second voltage, different from the first voltage, is applied from said second voltage applying unit to said second transfer unit, and wherein the second voltage is opposite in polarity from the first voltage.

12. An image forming apparatus according to claim 11, wherein between said first transfer unit and said first voltage applying unit, a first predetermined electric resistor is provided.

13. An image forming apparatus according to claim 12, wherein between said second transfer unit and said second voltage applying unit, a second predetermined electric resistor is provided.

14. An image forming apparatus according to claim 11, wherein said controller applies no voltage from said second voltage applying unit to said second transfer unit during image formation.

15. An image forming apparatus according to claim 11, wherein said first image bearing member is provided downstream of said second image bearing member with respect to a movement direction of said belt.

16. An image forming apparatus according to claim 14, wherein said second transfer unit contacts said belt during image formation under application of the transfer voltage from said first voltage applying unit to said first transfer unit.

17. An image forming apparatus according to claim 11, wherein said controller is capable of executing an operation in a monochromatic mode in which the toner image is transferred from only said first image bearing member, and wherein when said controller executes the operation in the monochromatic mode, the transfer voltage is applied to said first transfer unit.

* * * * *